US005703336A

United States Patent [19]

Tark et al.

[11] Patent Number: 5,703,336

[45] Date of Patent: Dec. 30, 1997

[54] EXHAUST NOISE SUPPRESSING APPARATUS FOR HERMETIC COMPRESSOR

[75] Inventors: Kyoung Sig Tark; Sung Oun Park, both of Changwon, Rep. of Korea

[73] Assignee: LG Electronics Inc., Rep. of Korea

[21] Appl. No.: 638,293

[22] Filed: Apr. 26, 1996

[30] Foreign Application Priority Data

Nov. 2, 1995 [KR] Rep. of Korea ..... 39365/1995
Dec. 13, 1995 [KR] Rep. of Korea ..... 49223/1995

[51] Int. Cl.[6] ..... F01N 1/12

[52] U.S. Cl. ..... 181/179; 181/403; 417/312

[58] Field of Search ..... 417/312; 181/403, 181/279, 280

[56] References Cited

U.S. PATENT DOCUMENTS 1,812,413 6/1931 Reynolds ..... 181/279
2,908,344 10/1959 Mauro ..... 181/279 X
3,750,840 8/1973 Holme ..... 181/403 X
4,111,278 9/1978 Bergman ..... 181/403 X
4,579,195 4/1986 Nieri ..... 181/280 X

*Primary Examiner*—Richard E. Gluck
*Attorney, Agent, or Firm*—Ostrolenk, Faber, Gerb & Soffen, LLP

[57] ABSTRACT

An improved exhaustion noise suppressing apparatus for a hermetic compressor directed to minimizing vibration of a refrigerator cycle pipe mechanism caused by a pressure difference of an exhausting gas pressure of the exhausting gas which is discharged from the system to the outside of the compressor by providing a damping member for offsetting a pressure wave form of the refrigerant gas to one side of the interior of the exhaustion noise suppressing unit wherein the compressed refrigerant gas discharged from the cylinder and the exhausting chamber is introduced into the loop pipe through the head cover and the exhaustion noise suppressing unit.

6 Claims, 4 Drawing Sheets

EXHAUST NOISE SUPPRESSING APPARATUS FOR HERMETIC COMPRESSOR

BACKGROUND OF THE INVENTION

1. Field of the Invention

The present invention relates to an exhaustion noise suppressing apparatus for a hermetic compressor, and particularly to an improved exhaustion noise suppressing apparatus for a hermetic compressor capable of reducing an exhaustion noise caused by a vibration of the system, when discharging the refrigerant gas, by providing a damping member having an extended refrigerant gas exhausting path.

2. Description of the Conventional Art

FIGS. 1 and 2 show a conventional hermetic compressor, which includes a lower housing 1 formed at a lower portion of the compressor body for storing a refrigerant oil, an upper housing 2 in which a hermetic space is formed in cooperation with the lower housing 1, a sealed electric unit 3 to which an external electric power is supplied, a driving unit 6 having a rotor 4 and a stator 5 for generating a certain driving force by receiving an electric power from the sealed electric unit 3, a crank shaft 7 coupled to the rotor 4 and having an oil flowing path 7' through which the refrigerating oil in the lower housing 1 is supplied to the upper portion of the system, a piston 8 engaged to an eccentric portion formed at an upper portion of the crank shaft 7, and a cylinder 9 in which a refrigerant gas, which is introduced thereinto in cooperation with the piston 8, is compressed.

The operation of the conventional hermetic compressor will now be explained with reference to the accompanying drawings.

To begin with, when an electric power is supplied to the driving unit 6 through the sealed electric unit 3, the rotor 4 is rotated, and the crank shaft 7 drivingly engaged to the rotor 4 is driven. A slider 10 connected to the crank shaft 7 is thereby linearly driven in cooperation with the eccentric portion of the crank shaft 7. The piston 8 linearly reciprocates within the cylinder 9 in cooperation with the driving of the slider 10. Through the above-explained operation of the system, a refrigerant gas in the interior of the system is introduced into the cylinder 9 in cooperation with the reciprocating movement of the piston 8, and the refrigerant gas is compressed therein as the piston 8 reciprocates therewithin, and the compressed and high-pressure refrigerant gas is exhausted to the outside of the system. The refrigerant oil stored in the lower housing 1 is sucked up to each friction portion of the system through the refrigerant oil flowing path 7' of the crank shaft 7 in cooperation with the centrifugal force of the crank shaft 7, so that a proper lubricating operation in the system is performed thereby.

Next, the construction and operation of the conventional exhaustion noise suppressing apparatus which is directed to suppressing exhaustion noise generated when exhausting a refrigerant gas will now be explained with reference to FIGS. 2 and 3.

An exhausting chamber 11 for receiving a refrigerant gas compressed by the piston 8 in the cylinder 9 is formed at an upper portion of a head cover 12, and an exhaustion noise suppressing unit 13, into which a high-pressure refrigerant gas is flown from the exhausting chamber 11, is provided at an opposing side of the head cover 12. The compressed refrigerant gas in the exhaustion noise suppressing unit 13 is discharged to the outside through a loop pipe 14.

However, the conventional exhaustion noise suppressing apparatus for a hermetic compressor has disadvantages in that since the compressor intermittently performs a suction cycle, a compression cycle, and an exhausting cycle, a refrigerant gas is also intermittently exhausted from the system, so that there is a large pressure difference between the maximum pressure and the minimum pressure due to the large pressure variation of the refrigerant gas. That is, when a refrigerant gas having a high pressure difference between the maximum pressure and the minimum pressure and a certain pressure wave form as shown in FIG. 3 is introduced into the system such as a refrigerator, pipes provided in the system are vibrated, producing audible noises.

SUMMARY OF THE INVENTION

Accordingly, it is an object of the present invention to provide an exhaustion noise suppressing apparatus for a hermetic compressor, which overcomes the problems encountered in the conventional exhaustion noise suppressing apparatus for a hermetic compressor.

It is another object of the present invention to provide an improved exhaustion noise suppressing apparatus for a hermetic compressor capable of minimizing vibration caused by a pressure difference of exhausting gas by introducing the refrigerant gas discharged from the exhausting chamber into an exhaustion noise suppressing unit through a damping member, so that the pressure difference of the exhausting gas can be offset in the damping member.

It is another object of the present invention to provide a damping member having a spirally shaped pipe or a scroll shape guiding groove.

To achieve the above objects, there is provided an exhaustion noise suppressing apparatus for a hermetic compressor, which includes an exhaustion noise suppressing unit having an inlet port communicating with an exhausting chamber and an outlet port formed at the opposed portion thereof; and a damping member for guiding a compressed refrigerant gas into the interior of the exhaustion noise suppressing unit.

DETAILED DESCRIPTION OF THE INVENTION

Figure 1:
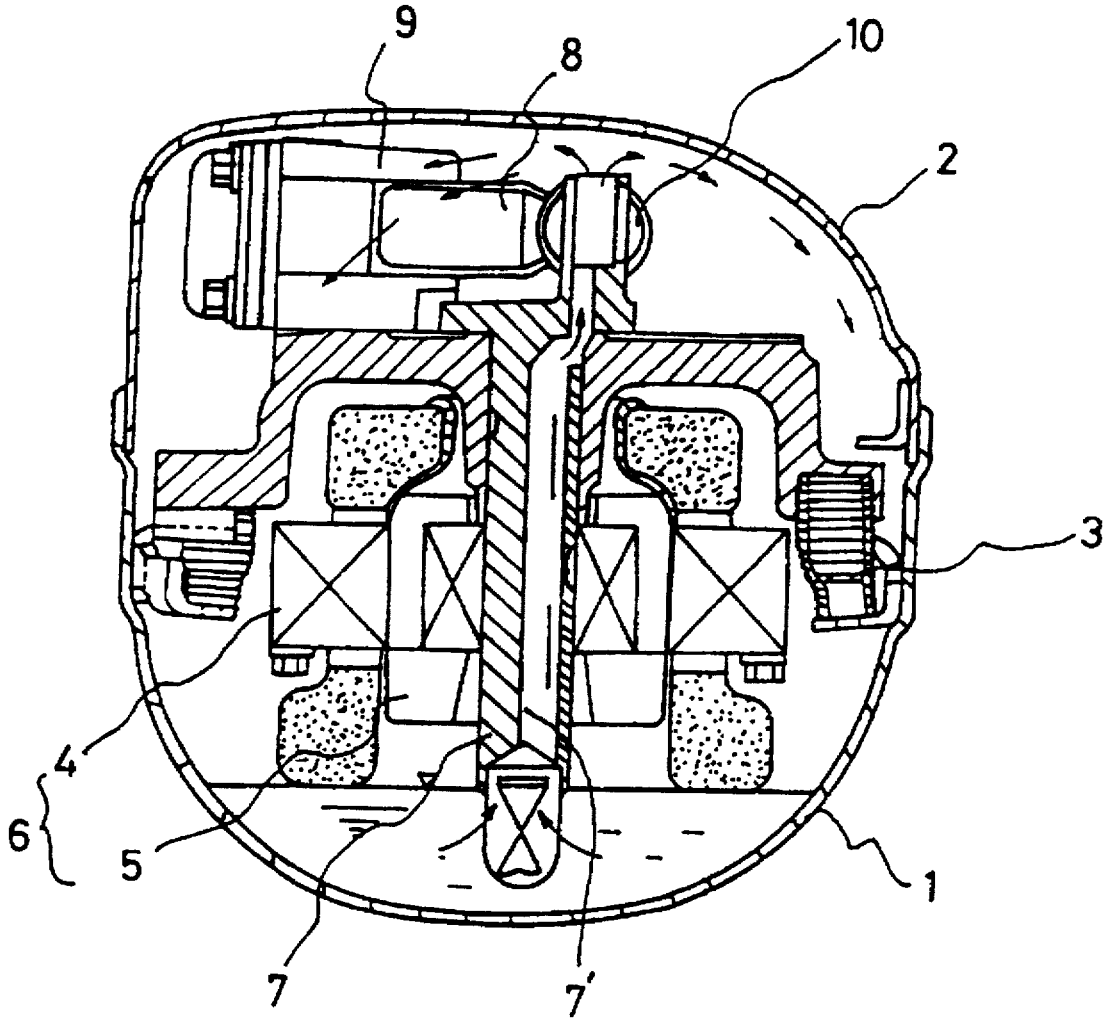
FIG 1 CONVENTIONAL ART
FIG. 1 is a vertical cross-sectional view of a conventional hermetic compressor.
Figure 2:
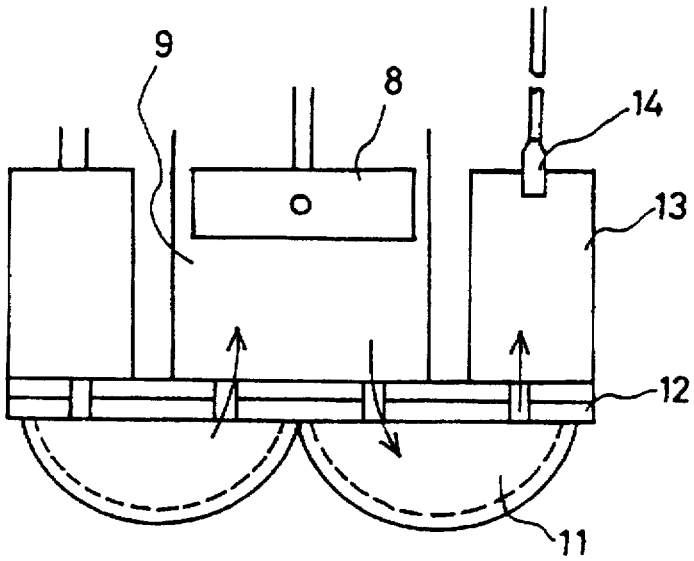
FIG 2 CONVENTIONAL ART
FIG. 2 is a schematic cross-sectional view of an exhaustion noise suppressing apparatus for a conventional hermetic compressor.
Figure 3:
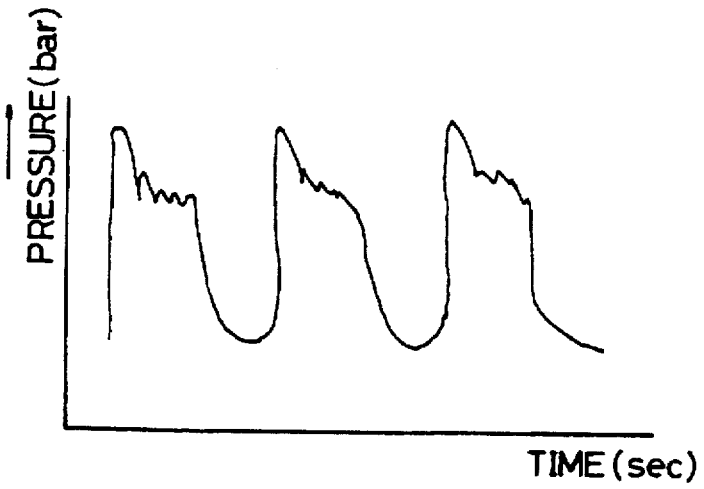
FIG 3 CONVENTIONAL ART
FIG. 3 is a graph of an exhausting pressure wave form of a conventional hermetic compressor.
Figure 4:
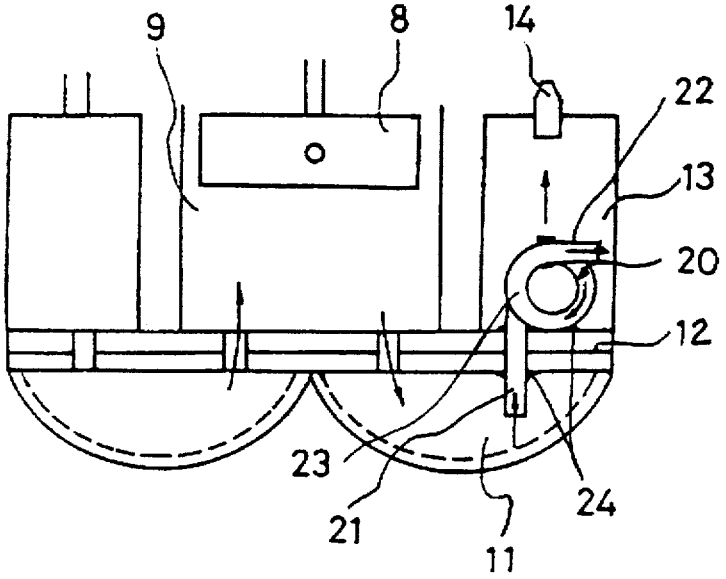
FIG. 4 is a schematic cross-sectional view of an exhaustion noise suppressing apparatus for a hermetic compressor of an embodiment of the present invention.
Figure 5:
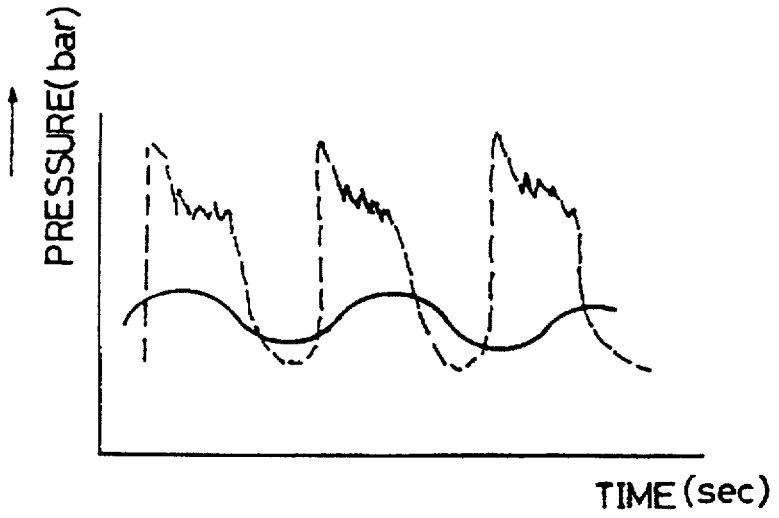
FIG. 5 is a graph of an exhausting pressure wave form of a hermetic compressor according to the present invention.

FIG. 4 shows an exhaustion noise suppressing apparatus for a hermetic compressor of a first embodiment of the present invention, and FIG. 5 shows a graph of an exhausting pressure wave form of a hermetic compressor.

As shown therein, the exhaustion noise suppressing apparatus for a hermetic compressor includes a damping pipe 20 for guiding a compressed refrigerant gas in the exhaustion noise suppressing unit 13 to one side of the interior of the exhaustion noise suppressing unit 13, while smoothing wave forms of the noise, wherein a compressed refrigerant gas discharged from the cylinder 9 through the exhausting chamber 11 is exhausted to the loop pipe 14 through the head cover 12 and the exhaustion noise suppressing unit 13.

The damping pipe 20 includes an inlet end portion 21 inserted into the exhausting chamber 11 through the head cover 12 by a certain length, a wind-up section 23 disposed in the exhaustion noise suppressing unit 13 and spirally shaped to lengthen the refrigerant gas flowing path, and an outlet end portion 22 disposed at an angle of about 90° with respect to the direction of the loop pipe 14, that is, in the outlet side of the exhaustion noise suppressing unit 13.

A portion where the damping pipe 20 and the head cover 12 contact with each other is welded so as to prevent a movement of the damping pipe 20. In the drawings, reference numeral 24 denotes a welded portion of the damping pipe 20.

The operation and effects of the exhaustion noise suppressing apparatus for a hermetic compressor according to the present invention will now be explained with reference to the accompanying drawings.

To begin with, a refrigerant gas compressed by the piston in the cylinder 9 is first exhausted into the exhausting chamber 11, and the refrigerant gas is introduced into the exhaustion noise suppressing unit 13 through the damping pipe 20 of which its inlet end portion 21 is extended into the exhausting chamber 11.

At this time, since the damping pipe 20 is spiral-shaped in the interior of the exhaustion noise suppressing unit 13, the noise wave cycles of the refrigerant gas is mixed while passing through the wind-up portion 23 of the damping pipe 20, so that it is possible to obtain a certain noise pressure wave form having a low pressure difference between the maximum pressure and the minimum pressure, and thus a vibration noise can be reduced.

In addition, since the outlet end portion 22 of the damping pipe 20 is arranged at an angle of about 90° with respect to the loop pipe 14, that is, in the direction of the outlet side of the exhaustion noise suppressing unit 13, the refrigerant gas introduced into the exhaustion noise suppressing unit 13 through the damping pipe 20 is first circulated in the interior of the exhaustion noise suppressing unit 13 and passes through the loop pipe 14, so that a vibration noise can be more effectively reduced.

FIG. 5 shows a graph of an exhausting pressure wave form of a hermetic compressor according to the present invention, where the dotted line denotes an exhausting pressure wave form of a refrigerant gas of a conventional hermetic compressor and the real line denotes an exhausting pressure wave form of a refrigerant of a hermetic compressor according to the present invention. As shown therein, it is noted that a pressure difference between the maximum pressure and the minimum pressure of a refrigerant gas passed through the damping pipe according to the present invention is relatively low, as compared to the prior art.

Figure 6:
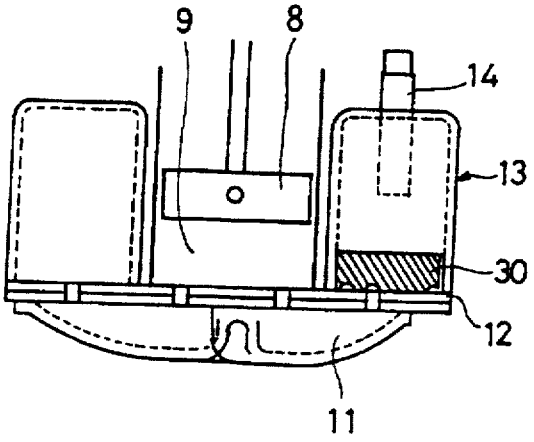
FIG. 6 is a cross-sectional view of an exhaustion noise suppressing apparatus for a hermetic compressor of another embodiment of the present invention.
Figure 7:
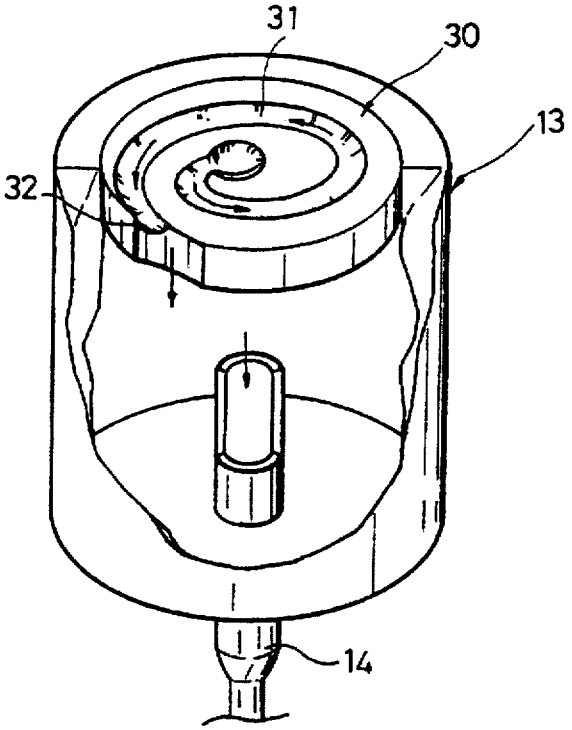
FIG. 7 is a partially cutaway perspective view of an interior construction of an exhaustion noise suppressing apparatus of FIG. 6 according to the present invention.

FIG. 6 shows an exhaustion noise suppressing apparatus for a hermetic compressor of a second embodiment of the present invention, and FIG. 7 is a partially cutaway perspective view showing an interior construction of an exhaustion noise suppressing apparatus of FIG. 6 according to the present invention. As shown therein, the second embodiment of the present invention is directed to providing a damping member 30 having a scroll shape guiding groove 31 for rotatingly guide the compressed refrigerant gas at one side of the interior of the exhaustion noise suppressing unit 13.

The guiding groove 31 of the damping member 30 is outwardly scrolled from the center thereof.

In addition, a path 32 communicating with an outer end portion of the guiding groove 31 is formed at an outer surface of the damping member 30, so that the refrigerant gas can be introduced into the exhaustion noise suppressing unit 13 through the guiding groove 31 of the damping member 30 and the path 32.

As described above, the second embodiment of the present invention is directed to suppressing an exhaustion noise of a refrigerant gas by reducing the exhausting gas pressure difference so that the compressed refrigerant gas discharged from the cylinder 9 is introduced into the exhaustion noise suppressing unit 13 through the scroll shape guiding groove 31 of the damping member 30, as compared to the prior art which is directed to permitting the refrigerant gas to directly flow into the exhaustion noise suppressing unit 13 from the exhausting chamber 11.

Although the preferred embodiments of the present invention have been disclosed for illustrative purposes only, those skilled in the art will appreciate that various modifications, additions and substitutions are possible, without departing from the scope and spirit of the invention as described in the accompanying claims.

What is claimed is:

1. An exhaust noise suppressing apparatus for a hermetic compressor, the apparatus comprising:

an exhaust noise suppressing unit forming a single chamber having an inlet port at one end thereof for communicating with an exhausting chamber of the hermetic compressor and having an outlet port at another end thereof; and damping means provided at the inlet port of the exhaust noise suppressing unit for guiding a compressed refrigerant gas from the exhausting chamber of the hermetic compressor into the exhaust noise suppressing apparatus unit while damping vibration noise in the refrigerant gas being guided as the refrigerant gas reaches the single chamber exhaust noise suppressing unit.

2. The apparatus of claim 1, wherein said damping means is a spiral shaped pipe having one end extending through the inlet port of the exhaust noise suppressing unit and into the exhaust chamber of the hermetic compressor, and having an opposite end thereof directed generally perpendicularly to the outlet port of the exhaust noise suppressing unit.

3. The apparatus of claim 1, wherein said damping means is a damping member fixed to an interior of the exhaustion noise suppressing unit.

4. The apparatus of claim 3, wherein said damping member includes a guiding groove communicating with the inlet portion of the exhaustion noise suppressing unit.

5. The apparatus of claim 4, wherein said guiding groove is scroll-shaped and externally formed from the center thereof.

6. The apparatus of claim 5, wherein said damping member includes a path formed at an outer surface thereof and communicating between one portion of the guiding groove and the exhaustion noise suppressing unit.

* * * * *